United States Patent [19]

Davis et al.

[11] 4,165,292

[45] Aug. 21, 1979

[54] LUBRICANT CORROSION INHIBITOR

[75] Inventors: Bryan T. Davis, West Bloomfield, Mich.; Nicholas W. Moat, Toronto, Canada

[73] Assignee: Edwin Cooper and Company Limited, Bracknell, England

[21] Appl. No.: 883,165

[22] Filed: Mar. 3, 1978

Related U.S. Application Data

[62] Division of Ser. No. 688,680, May 21, 1976, abandoned.

[30] Foreign Application Priority Data

May 23, 1975 [GB] United Kingdom ..... 22508/75

[51] Int. Cl.[2] ..... C10M 1/32

[52] U.S. Cl. ..... 252/51.5 A; 252/50; 252/390; 252/392

[58] Field of Search ..... 252/50, 51.5 R, 51.5 A, 252/56 D, 390, 392

[56] References Cited

U.S. PATENT DOCUMENTS

| | | | |
|---|---|---|---|
| 1,789,927 | 1/1931 | Murrill et al. | 252/50 |
| 1,888,023 | 11/1932 | Adams | 252/51.5 R |
| 2,239,841 | 4/1941 | Cook | 252/51.5 R |
| 2,361,339 | 10/1944 | White et al. | 252/51.5 R |
| 2,442,672 | 6/1948 | von Fuchs et al. | 252/56 D |
| 2,511,747 | 6/1950 | Smith et al. | 252/50 |
| 2,511,748 | 6/1950 | Smith et al. | 252/50 |
| 2,779,740 | 1/1957 | Messina | 252/51.5 A |
| 2,917,160 | 12/1959 | Turinsky | 252/51.5 R |
| 3,030,387 | 4/1962 | Benoit | 252/56 D |
| 3,977,987 | 8/1976 | Pinke et al. | 252/50 |

*Primary Examiner*—Delbert E. Gantz
*Assistant Examiner*—Andrew Metz
*Attorney, Agent, or Firm*—Donald L. Johnson; Robert A. Linn; Joseph D. Odenweller

[57] ABSTRACT

Lubricating oils for internal combustion engine containing a minor amount of a combination of (A) an oil soluble basic organic nitrogen compound having a total base number of at least 300 and a pH of at least 9.5, and (B) an alkyl or alkenyl succinic acid containing 10–50 carbon atoms have improved corrosion properties.

13 Claims, No Drawings

LUBRICANT CORROSION INHIBITOR

CROSS REFERENCE TO RELATED CASE

This application is a division of application Ser. No. 688,680, filed May 21, 1976 now abandoned.

This invention relates to corrosion inhibitors for lubricants for internal combustion engines. In particular, the invention relates to formulations of automotive crankcase lubricants, especially when low-ash or ashless formulations are desired.

BACKGROUND

Automotive crankcase lubricants generally contain appreciable amounts of overbased metal compounds, particularly overbased alkaline earth metal or magnesium petroleum or alkyl benzene sulphonates. These overbased metal compounds provide effective rust inhibition by neutralizing corrosion acidic combustion products from the fuel, such as hydrochloric and hydrobromic acid from the lead scavengers normally present and low molecular weight organic acids from the oxidation of the fuel itself. In the absence of overbased additives, as in ashless oils, or when such additives are present in reduced amounts, as in "low-ash" oils, rusting becomes a serious problem.

Various commonly known ashless rust-inhibitors have been tried in ashless automotive crankcase oils with little success. However, we have now found a combination of additives providing effective rust-inhibition in ashless oils as well as in oils which contain ash-producing components.

SUMMARY

A need has therefore been shown for a non-ash forming corrosion or rust inhibitor to which this invention is directed. According to the invention a composition, effective for a crankcase lubricating oil for internal combustion engines, is provided comprising a major amount of lubricating oil, preferably mineral lubricating oil, and a minor amount of a combination of two additives A and B, wherein: A is an oil-soluble basic organic nitrogen compound having a total base number of at least 300 mg. KOH/g. and which is at least sufficiently soluble in, or hydrolyzed by, water to give an aqueous solution of pH at least 9.5; and B is an alkenyl or alkyl substituted succinic acid having a total of about 12 to about 50, preferably up to 30, and especially 12 to 22 carbon atoms total. Further, in said composition, the components A and B are provided in the weight ratio A/B of from 1/2 to 2/1.

DESCRIPTION OF THE PREFERRED EMBODIMENTS

A preferred embodiment of this invention is a lubricating oil for internal combustion engines comprising a major amount of lubricating oil and a minor corrosion inhibiting amount of a combination of two additives A and B wherein A is an oil-soluble basic nitrogen compound having a total base number of at least 300 mg. KOH/g. and which is at least sufficiently soluble in or hydrolyzed by water to give an aqueous solution of pH at least 9.5: and B is an alkyl or alkenyl succinic acid having from 12 to 22 carbon atoms, said A and B components having a weight ratio A/B of from 1/2 to 2/1.

In accordance with the invention, the basic organic nitrogen compound or products of hydrolysis thereof must be capable of providing an aqueous solution having a pH of at least 9.5. The suitability of compounds in this respect can be simply determined by dissolving 0.05 gms of the compound in 100 mls of deionized water, previously neutralized to pH 7, and measuring the pH of the resulting solution.

A class of basic organic nitrogen compounds which has been found useful has the general formula:

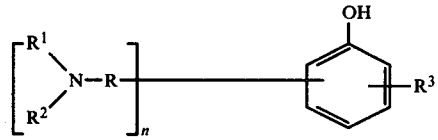

wherein R is an alkylene group, e.g. lower $C_{1-4}$ alkylene preferably methylene, $R^1$ and $R^2$ may be the same or different and are hydrogen, or alkyl, e.g. $C_{1-4}$ lower alkyl, preferably methyl or ethyl, alkyl aminoalkyl or dialkyl-aminoalkyl groups wherein the alkyls are $C_{1-4}$, provided that $R^1$ and $R^2$ are not both hydrogen; n is 2 or 3 and $R^3$ is a hydrogen atom, a lower $C_{1-4}$ alkyl group, preferably methyl or ethyl, or the group

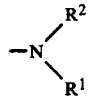

wherein $R^1$ and $R^2$ are as defined above.

A particularly useful example of this class has the formula

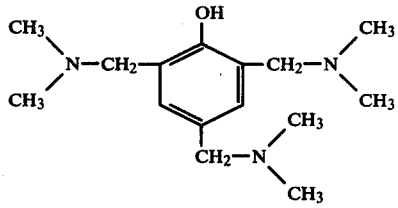

i.e. 2,4,6-tris(N,N-dimethyl amino methyl)phenol.

Alternatively there may be used polymeric products prepared by the reaction of primary amines and formaldehyde with a phenol.

A further class of compounds which has been found useful has the general formula:

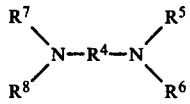

wherein $R^4$ is a straight or branched chain alkylene group or a cycloalkylene group containing 2 to about 6 carbon atoms, and $R^5$, $R^6$, $R^7$ and $R^8$ are independently hydrogen, lower $C_{1-4}$ alkyl, preferably methyl or ethyl, or the group

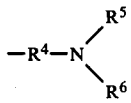

wherein $R^4$, $R^5$ and $R^6$ are as defined above, provided that not more than 20, preferably not more than 10, nitrogen atoms are present in the molecule, and the ratio of carbon to nitrogen is such as to render the compound appreciably soluble in water. Particularly useful examples of this class have the formulae:

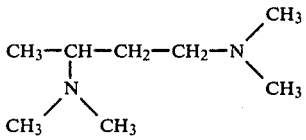

I

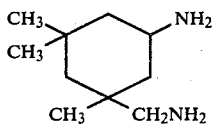

II i.e. (I) N,N,N',N'-tetramethyl-1,3-diaminobutane and (II) isophorone diamine.

Further classes of compounds which have been found useful are the reaction products of aldehydes or ketones with water-soluble primary or secondary aliphatic, cycloaliphatic or heterocyclic amines or hydroxy-amines.

Primary monoamines react with aldehydes or ketones to give aldimines and ketimines of respective formulae:

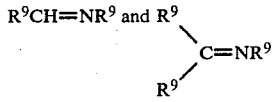

wherein the $R^9$ group attached to the nitrogen atom may be alkyl (e.g. alkyl containing 1–12 carbon atoms) aralkyl containing 7 to about 12 carbon atoms, or cycloalkyl containing 5 to about 12 carbon atoms, optionally containing one or more nitrogen atoms and wherein the $R^9$ groups attached to carbon may be alkyl, aralkyl or cycloalkyl as before, provided that when two groups $R^9$ are attached to the same carbon atom they may jointly form a single cycloalkyl group, and provided that the ratio of carbon to nitrogen in $R^9NH_2$ is such as to render $R^9NH_2$ appreciably soluble in water. Furthermore, secondary mono-amines give compounds of formula

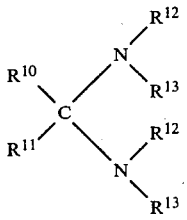

wherein $R^{10}$ is an alkyl containing 1 to about 12 carbon atoms or aryl group containing 6 to about 12 carbon atoms, $R^{11}$ is H or an alkyl containing 1 to about 12 carbon or aryl group containing 6 to about 12 carbon atoms, or $R^{10}$ and $R^{11}$ may together form part of a ring structure, and $R^{12}$ and $R^{13}$ are lower $C_{1-4}$ alkyl or hydroxyalkyl groups, e.g. hydroxyethyl, or may together form part of a heterocyclic ring. When the amine chosen is a 2-hydroxy substituted primary or secondary amine, reaction with an aldehyde or a ketone yields an oxazolidine whereas if the amine chosen is substituted in the 2-position by a primary or secondary amino group an imidazolidine is formed. If the amine is substituted in the 3-position by a hydroxyl group or a primary or secondary amino group, the compounds formed are tetrahydro-1,3oxazines and tetrahydropyrimidines respectively. Typical formulae are:

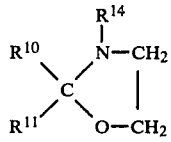

oxazolidine

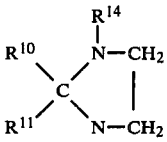

imidazolidine

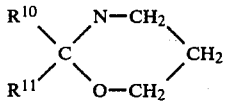

tetrahydro-1,3-oxazine

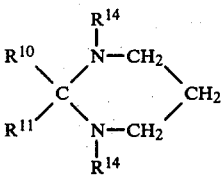

tetrahydropyrimidine where $R^{14}$ is H, lower $C_{1-4}$ alkyl, hydroxyalkyl, e.g. hydroxyethyl, or alkylaminoalkyl wherein the alkyl portion contains 1 to about 4 carbon atoms.

All of these compounds are hydrolyzed by water, especially in the presence of acids, to the parent aldehyde or ketone and amine and by this means it is possible to prepare an oil-soluble derivative of an oil-insoluble water-soluble amine which will release the amine into the aqueous phase under engine operating conditions.

The aldehyde or ketone chosen will depend on the amine selected and the degree of oil solubility which it is desired to confer. Aldehydes are preferred to ketones since they react more readily; formaldehyde, acetaldehyde and higher aliphatic aldehydes such as n-butyraldehyde and n-heptaldehyde may be used, but benzaldehyde is particularly preferred. Examples of suitable ketones are acetone, methyl ethyl ketone, methyl isobutyl ketone and cyclohexanone.

The amine may be a mono-, di- or polyamine or a hydroxy-substituted amine, such as mono- or diethanolamine. Particularly useful amines are those which contain additional basic nitrogens in the molecule such as dimethylaminopropylamine and its homologues and bis aminopropyl piperazine.

Specific examples of compounds which have proved effective in automotive crankcase lubricants are bis(benzal aminopropyl)piperazine benzal aminopropyl dimethylamine 2-propyl-3-methyl oxazolidine.

A further class of compounds which has been found useful as additive A has the general formula:

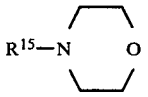

wherein $R^{15}$ is alkyl e.g. lower alkyl containing 1 to about 4 carbon atoms, preferably ethyl. A particularly useful example of the class has the formula:

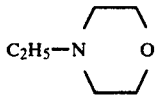

i.e. N-ethyl morpholine.

A further class of compounds which has been found useful has the general formula:

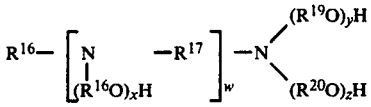

wherein $R^{16}$ is alkyl, preferably lower $C_{1-4}$ alkyl; $R^{17}$ is lower alkylene preferably ethylene or propylene; $R^{18}$, $R^{19}$ and $R^{20}$ are the same or different and are alkylene, preferably ethylene or propylene; w is 0, 1, 2 or 3; and x, y and z are the same or different and each is an integer of from 1 to 5, preferably 1 or 2. A particularly preferred member of this class, which has been found useful, has the formula:

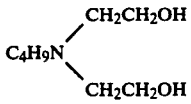

i.e. N-n-butyl diethanolamine.

The B component has the general formula:

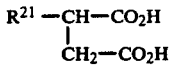

wherein $R^{21}$ is a straight or branched chain alkyl or alkenyl group containing 8 to 46, preferably 8 to 26 and especially 8 to 18 carbon atoms. For reasons of better oil solubility $R^{21}$ is preferably an alkenyl group or a branched chain alkyl group. A member of this class which has been shown to be particularly useful is tetrapropenyl succinic acid (TPSA).

Component A of the lubricating compositions of the present invention will normally be present in an amount of from 0.1% to 10% by weight, more preferably 0.2% to 2.0% by weight, based on the total weight of the composition. Component B will normally be present in an amount of from 0.1% to 10% by weight, more preferably 0.2% to 2.0% by weight, based on the total weight of the composition. An essential requirement of this invention is the use of the basic organic nitrogen compound and the carboxylic acid compound together. Without the organic nitrogen compound, the tetrapropenyl succinic acid was found to have only limited rust-inhibiting properties in automotive crankcase oils. Without the carboxylic acid, the basic nitrogen compounds exhibited no rust-inhibiting properties when used at chemically equivalent concentrations. Better results have been obtained than would have been expected using either the acid or the amine component alone. Still better results have been obtained by using proportions of amine to acid such that an excess of amine over that required to form the neutral salt of the acid was present. The use of excess amine over that required to neutralize the carboxylic acid is therefore highly preferred.

The combination of components A and B in accordance with the present invention effectively reduces corrosion, as measured by the ASTM Sequence IIC engine test, and also reduces the formation of lead-containing deposits which occur in the hydraulic valve lifters. It is believed that the formation of such deposits may be enhanced by the use of ashless sulphur-containing antioxidants. The use of a combination of components A and B in accordance with the present invention is therefore highly desirable in oil formulations which also contain such sulphur-containing antioxidants. However, the compositions of the present invention may also contain, if desired, other known lubricant additives. For example, compositions according to the present invention may contain commonly used ashless dispersants or detergents such as derivatives of polyisobutenyl succinic acid, e.g. PIB succinimides or PIB succinic acid esters or mono-carboxylic acid amides or esters derived from polyisobutylene or polypropylene formed by reacting the chlorinated hydrocarbon with acrylic acid.

Ashless antioxidants which may be used in the present invention include hindered phenols, i.e. phenols having at least one alkyl group, usually t-butyl, on the ring and adjacent to the OH group. Other antioxidants include sulphurized hydrocarbons, dithiocarbamates, phenothiazine derivatives and arylamines such as phenyl α-naphthylamine and its derivatives.

Zinc dialkyl dithiophosphate antioxidants may also be used provided any product of its interaction with component A is oil-soluble.

The following Table summarizes data which demonstrate the preferred embodiments of the invention, when used as additives for spark-ignition internal combustion engine lubricants. The evaluation procedure used the ASTM Sequence IIC engine-test according to the method described in ASTM Special Technical Publication 315F.

TABLE

| | | "A" | | | | |
|---|---|---|---|---|---|---|
| Formulation | "B" TPSA - % | Amine | % | Calcu. TBN | Wt. Ratio A/B | II C Rust Rating |
| A | 0.4 | None | 0 | — | — | 7.3 |
| A | 0.4 | Tris(dimethyl amino methyl) phenol | 0.4 | 635 | 1/1 | 8.7 |
| B | 0.4 | Tris(dimethyl amino methyl) phenol | 0.25 | 635 | 1/1.6 | 8.2 |
| B | 0.4 | Tris(dimethyl amino methyl) phenol | 0.4 | 635 | 1/1 | 8.6 |
| +C | 0.4 | Isophorone Diamine | 0.4 | 660 | 1/1 | 8.9 |
| C | 0 | Isophorone Diamine | 0.4 | 660 | — | 5.3 |
| C | 0.4 | Tetra methyl-1,3-diamino butane | 0.33 | 780 | 1/1.33 | 7.9 |
| C | 0.4 | Bis(benzal amino | 0.45 | 595 | 1.1/1 | 8.9 |

TABLE-continued

| Formulation | "B" TPSA - % | "A" Amine | % | Calcu. TBN | Wt. Ratio A/B | II C Rust Rating |
|---|---|---|---|---|---|---|
| | | propyl) piperazine | | | | |
| C | 0.4 | Benzal dimethyl amino propylamine | 0.45 | 588 | 1.1/1 | 8.4 |
| C | 0.4 | 2-propyl-3-methyl oxazolidine | 0.7 | 435 | 1.75/1 | 8.0 |
| C | 0.4 | N-ethyl morpholine | 0.6 | 488 | 1.5/1 | 7.8 |
| C | 0.4 | N-n-butyl diethanolamine | 0.7 | 348 | 1.75/1 | 8.1 |
| D | 0.2 | None | 0 | — | — | 5.4 |
| *+D | 0.4 | Tris(dimethyl amino methyl) phenol | 0.4 | 635 | 1/1 | 8.5 |

+Due to interactions of the amine with other additives some precipitation occurred in these blends.
*Blend contained 0.34% sulphated ash
0.08% zinc Blends A, B and C were all ashless blends containing succinimide or ester type ashless dispersants, ashless, sulphur-containing antioxidants and another corrosion inhibitor of the surface-active type.

Without limiting their invention to one mode of operation applicants believe that component A acts not as a surface-active rust inhibitor but in the body of the oil, by a process of pH modification, in much the same manner as the overbased sulphonates hereinbefore referred to. In this connection laboratory tests have shown that the pH of acidic aqueous solutions in contact with a lubricating oil containing A is modified, whereas no modification occurs in the absence of component A.

It has also been noted that the most effective species of component A are freely soluble in both oil and water. This is deemed to be an important factor since water is one of the principal components of combustion gases and it tends to condense to form aqueous acids. Consequently, in a highly preferred embodiment of the present invention component A is soluble in mineral oil in amounts of at least up to 2% and is also soluble, or hydrolyzed by, water. Additional desirable characteristics of component A are a high boiling point and low volatility.

We claim:

1. A lubricating oil for internal combustion engines comprising a major amount of lubricating oil and a minor corrosion inhibiting amount of a combination of two additives, A and B, wherein A is an oil-soluble basic nitrogen compound selected from the group consisting of tetramethyl-1,3-diaminobutane; bis(benzal aminopropyl)piperazine; benzal aminopropyl dimethylamine; 2-propyl-3-methyl oxazolidine; and a diamine having the formula

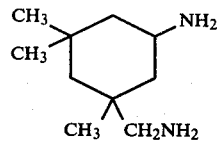

and B is an alkyl or alkenyl succinic acid having from 12–22 carbon atoms and said A and B have a weight ratio A/B of 1/2 to 2/1.

2. A composition of claim 1 wherein said additive A is tetramethyl-1,3-diaminobutane.

3. A composition of claim 1 wherein said additive A is bis(benzal aminopropyl)piperazine.

4. A composition of claim 1 wherein said additive A is benzal aminopropyl dimethylamine.

5. A composition of claim 1 wherein said additive A is 2-propyl-3-methyl oxazolidine.

6. A composition of claim 1 wherein said additive A has the formula

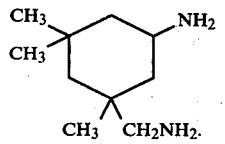

7. A composition of claim 1 wherein said additive B is an alkenyl succinic acid.

8. A composition of claim 1 wherein said additive B is tetrapropenyl succinic acid.

9. A composition of claim 2 wherein said additive B is tetrapropenyl succinic acid.

10. A composition of claim 3 wherein said additive B is tetrapropenyl succinic acid.

11. A composition of claim 4 wherein said additive B is tetrapropenyl succinic acid.

12. A composition of claim 5 wherein said additive B is tetrapropenyl succinic acid.

13. A composition of claim 6 wherein said additive B is tetrapropenyl succinic acid.

* * * * *